United States Patent [19]

Manninen et al.

[11] 3,951,039

[45] Apr. 20, 1976

[54] FIREARM WITH MUZZLE AND SMOOTH-BORE BARREL FOR FIRING FINNED PROJECTILES

[75] Inventors: Paavo Erkki Manninen; Niilo Asikainen, both of Tampere, Finland

[73] Assignee: Oy Tampella Ab, Tampere, Finland

[22] Filed: Oct. 22, 1971

[21] Appl. No.: 191,825

Related U.S. Application Data

[63] Continuation-in-part of Ser. No. 836,892, June 26, 1969, abandoned.

[52] U.S. Cl. ..... 89/14 C

[51] Int. Cl.[2] ..... F41F 17/12

[58] Field of Search ..... 89/1.816, 1.817, 1.818, 89/14 R, 14 B, 14 C, 14 D

[56] References Cited

UNITED STATES PATENTS

| | | | |
|---|---|---|---|
| 1,380,358 | 6/1921 | Cooke | 89/14 C |
| 2,457,802 | 1/1949 | Bauer | 89/14 C |
| 2,811,901 | 11/1957 | Barr | 89/14 C |

FOREIGN PATENTS OR APPLICATIONS

| | | | |
|---|---|---|---|
| 715,769 | 12/1931 | France | 89/14 C |
| 298,935 | 12/1919 | Germany | 89/14 D |
| 4,631 | 1907 | United Kingdom | 89/14 C |
| 18,491 | 1912 | United Kingdom | 89/14 C |

OTHER PUBLICATIONS

Oscar Schwager, "The Muzzle Brake," *Coast Artillery Journal*, May–June 1945, pp. 32–36.

*Primary Examiner*—Stephen C. Bentley
*Attorney, Agent, or Firm*—John C. Smith, Jr.

[57] ABSTRACT

A firearm having a smooth-bore barrel for firing fin-stabilized projectiles includes a muzzle assembly at the end of the barrel for stabilizing the projectile as it leaves the barrel upon being fired. The muzzle assembly includes a radial opening portion having apertures along the periphery of the assembly to exhaust firing gases therethrough. A gas guiding or diverting structure is mounted along the outside of the assembly and includes a deflection surface adjacent the apertures in the radial opening portion to divert any exhausted firing gases radially from the barrel and thereby prevent the exhausted firing gases from affecting the trajectory of the finned projectile. The aperture may be formed as slots in the barrel adjacent its end or provided between the end of the barrel and the gas guiding structure which is displaced laterally from the muzzle opening of the barrel along the longitudinal axis thereof. Either type of structural relationship between the gas guiding structure and the barrel end eliminates the formation of turbulence zones created by the exhausted firing gases at the end of the barrel which affect the trajectory of the finned projectile.

2 Claims, 3 Drawing Figures

INVENTORS
P.E. MANNINEN & N. ASIKAINEN
BY
Lowry, Rivelant & Maikva
ATTYS.

INVENTORS
P. E. MANNINEN & N. ASIKAINEN
BY
Lowry, Rinehart & Markva
ATTYS.

FIREARM WITH MUZZLE AND SMOOTH-BORE BARREL FOR FIRING FINNED PROJECTILES

This application is a continuation-in-part of our copending application Ser. No. 836,892 filed June 26, 1969 now abandoned.

BACKGROUND OF THE INVENTION

The use of outlet slots or openings at the muzzle end of the barrel of a firearm designed for fin-stabilized projectiles to allow firing gases to escape is known in the prior art. These openings may be placed either in the smooth-bore barrel end itself or in a separate portion that is attached to the end of the barrel. The openings generally have the form of outlet slots which extend either transversely or longitudinally to the barrel axis. When the firing gases escape through these outlet openings located at the muzzle of the barrel, the gas pressure behind a fin-stabilized projectile is considerably reduced. The end of the barrel provides guidance for the finned projectile and by lessening the gas pressure behind the fin-stabilized projectile, the gases are no longer able to exert a deleterious influence on the trajectory of the projectile as it leaves the barrel. In other words, there is an increased stabilizing affect on the projectile as it is fired from the barrel and the unfavorable jet effect caused by the high gas pressure in firearms of this type is eliminated through the use of such openings. The scatter and trajectory of the finned projectiles is improved providing increased accuracy.

Although the placement of openings at the muzzle end of the firearm has greatly increased the efficiency of such firearms, the deleterious affect of the escaping firing gases has not been completely eliminated. The highly compressed firing gases are still capable of escaping from the barrel before the fin-stabilized projectile has left the barrel end and at least a portion of the escaping gases has been found to continue to flow further along the outer circumference or periphery of the barrel end in the direction of the barrel axis. As a result, areas of turbulence form which adversely affect the fin-stabilized projectile immediately after it has left the muzzle opening in the barrel. These areas of turbulence are obviously non-uniform from one firing of the weapon to the next, and therefore the affect on the fin-stabilized projectile will vary from firing to firing so that the direction of the fin-stabilized projectile will be unfavorably influenced.

The trajectory of a projectile fired through a barrel having rifling on its interior surface is not affected by firing gases at the end of the barrel, the reason being that the rifling imparts a twisting motion to the projectile after it is fired and before it leaves the barrel. Thus, unlike a fin-stabilized projectile fired from a smooth-bore barrel, the rotation of the projectile ejected from a rifled barrel stabilizes the projectile and it is discharged from the barrel such that its trajectory will not be affected by any turbulence caused by the firing gases at the end of the barrel. A fin-stabilized projectile fired from a barrel which necessarily must have a smooth bore since it can't be rotated does not have the inherent stability of a rotating projectile.

The shape of a fin-stabilized projectile seen in longitudinal section differs substantially from the cartridge of a rifle. The rear portion of the fin-stabilized projectile is tapered, and thus the gases escaping from the barrel upon firing the projectile have considerable influence on the discharge of the fin-stabilized projectile whereby the fin-stabilized projectile may become inclined in one direction or the other thereby affecting its trajectory.

PURPOSE OF THE INVENTION

The primary object of this invention is to further reduce any deleterious affect exerted on the fin-stabilized projectile by the gases which escape around a fin-stabilized projectile at the muzzle end of a smooth-bore barrel.

Another object of this invention is to provide a means for diverting the flow of escaping firing gases at the muzzle end of a smooth-bore barrel to avoid turbulence affecting the trajectory of a fin-stabilized projectile as it leaves the muzzle end of the smooth-bore barrel.

A still further object of this invention is to eliminate the affect of the flow of highly compressed gases along the outer circumference of the smooth-bore barrel end which create areas of turbulence and thereby adversely affect the trajectory of a fin-stabilized projectile.

Another object of this invention is to provide means for diverting the flow of escaping firing gases in a radial direction whereby the end of the barrel or muzzle assembly offers guidance to a fin-stabilized projectile, and turbulence which affects the trajectory of the fin-stabilized projectile is eliminated.

SUMMARY OF THE INVENTION

These objects and other advantages corresponding to the purpose of the invention are readily achieved by the construction of the end of the smooth-bore barrel or muzzle assembly made in accordance with the present invention. A gas guiding structure is located at the end of the smooth-bore barrel which includes apertures permitting firing gases to be exhausted radially and a deflection surface located adjacent the apertures which deflection surface extends obliquely outwardly and upwardly from the periphery of the barrel or muzzle assembly to cause any firing gases outside the barrel or muzzle assembly to be further diverted radially thereby preventing the highly compressed gases from creating areas of turbulence in front of the barrel or muzzle opening. The deflecting surface diverts the escaping firing gases radially so that they can no longer adversely affect the trajectory of the fin-stabilized projectile as it leaves the smooth-bore barrel end.

In a specific embodiment of this invention, the deflection surface is located on a guide ring which is located on the periphery of the assembly and thereby radially deflects the escaping gases around the entire circumference of the barrel end. This guide ring may be attached to the end of the barrel in several ways. When the apertures forming the radial opening portion of the muzzle assembly are located in the wall of the barrel end itself, the guide ring may be screwed directly onto the barrel structure. In another embodiment of the invention, the gas guiding ring may be laterally displaced from the muzzle opening end in a direction away from the barrel end along the longitudinal axis thereof. In the second embodiment, it is not necessary to form apertures in the end of the barrel construction itself. The radial opening portion of the muzzle assembly exists between the barrel end and the gas guide ring which is mounted in a displaced position therefrom.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figure 1:
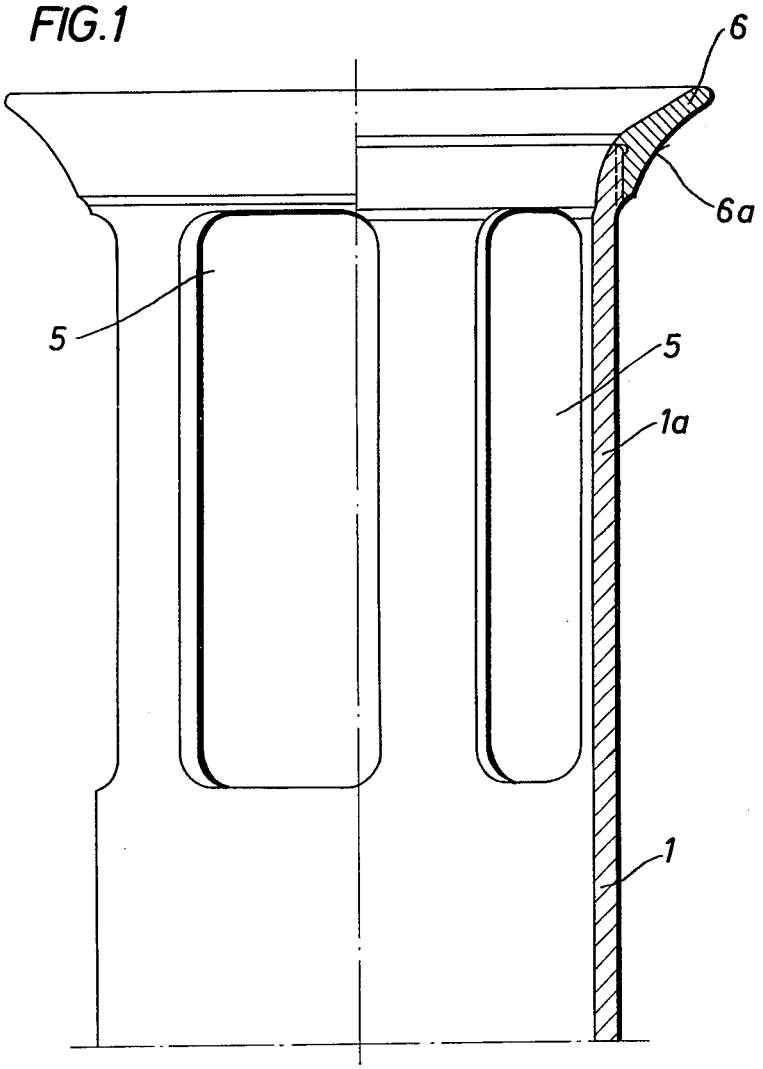
FIG. 1 is a longitudinal partial sectional view of a muzzle assembly made in accordance with this invention.

More specifically, in a first embodiment of this invention, the barrel 1 includes outlet slots 5 which are located at the barrel end 1*a* and extend longitudinally therealong as shown in FIG. 1. The length of the slots 5 must be a minimum of 1¼ times the internal diameter of the smooth bore barrel to be effective in exhausting the firing gases. The outlet slots 5 form the radial opening portion of the muzzle end assembly made in accordance with this invention. A circumferential guide ring 6 is screwed onto the barrel end 1*a* with corresponding threaded portions located on the ring 6 and barrel 1. A deflection surface 6*a* extends obliquely outwardly and upwardly from the periphery of the barrel 1. The cross-sectional outline of the deflection surface 6*a* is a concave curve in this specific embodiment as shown in FIG. 1. The deflection surface 6*a* begins at a location adjacent the outlet slots 5. Upon firing, the gases emerge from the slots 5 and any portion of the gas which has a propensity to move longitudinally along the outer circumference of the barrel is deviated upon contacting the deflection surface 6*a*. This deviation takes the gases in the most radial direction possible away from the circumference of the barrel. Deviation of the escaping gases by the deflection surface 6*a* extensively supplements a laminar outflow of the gases emerging from the slots 5. Any zones of turbulence or eddies which do occur are far enough away from the inner diameter of the barrel end 1*a* that they no longer have a deleterious affect on the movement of the fin-stabilized projectile as it leaves the barrel 1.

Figure 3:
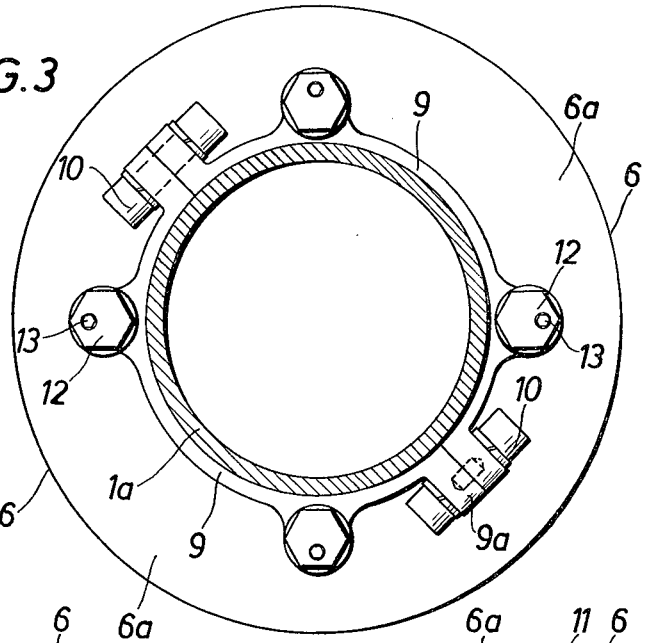
FIG. 3 is a sectional view along the line IV—IV of FIG. 2.
Figure 2:
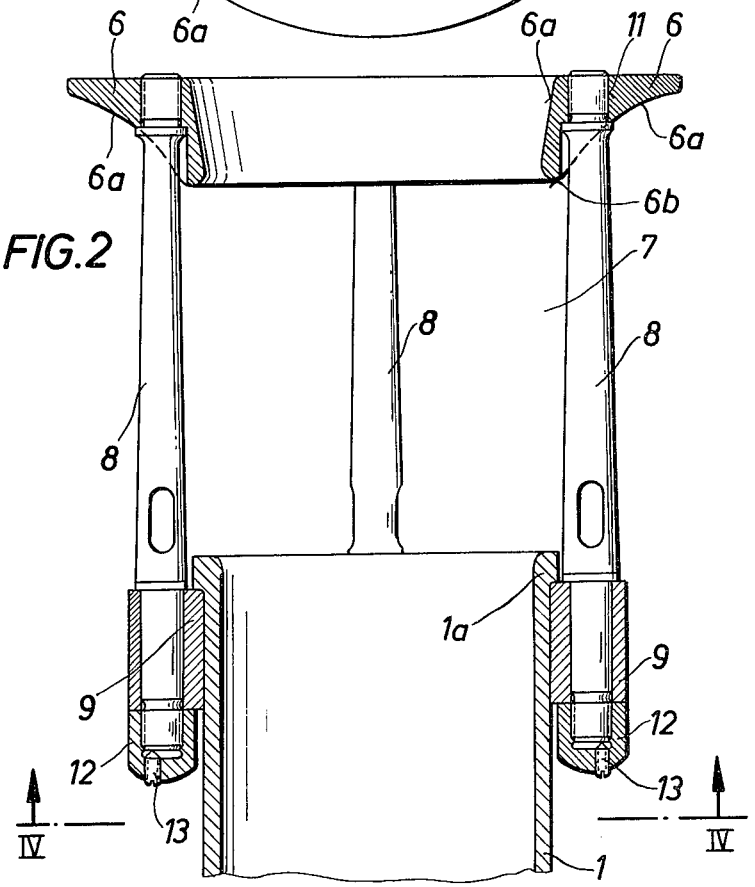
FIG. 2 is a longitudinal cross-sectional view of another embodiment of the muzzle assembly made in accordance with this invention.

Another embodiment of a muzzle assembly made in accordance with this invention is shown in FIGS. 2 and 3. The guide ring 6 is mounted at a displaced location in a direction away from the muzzle opening along the longitudinal axis of the barrel 1. In this specific embodiment no outlet slots are necessary in the barrel end 1*a*. The radial opening portion of the muzzle assembly is formed between the muzzle opening of the barrel end 1 and the guide ring 6 and includes the outlet space 7. Upon firing the projectile 20 the firing gases emerge out of the muzzle opening in the barrel end 1*a* and escape radially outwardly from the outlet space 7 which must have a minimum length of 1¼ times the internal diameter of the smooth-bore barrel. When the emerging gases contact the deflection surface 6*a* located on the guide ring 6, the maximum amount of deflection possible is effected. The guide ring 6 also includes a rounded surface 6*b* on the end thereof which faces the barrel end 1*a*. The inner surface 6*c* of the guide ring 6 extends conically outwardly in a direction away from the barrel end 1*a*.

The diameter of the inner surface 6*c* is substantially equal to or at the most only slightly larger than the internal diameter of the smooth-bore barrel since this inner surface serves as a guide surface for the fin-stabilized projectile after passing the outlet space 7. The upper surface of the guide ring 6 is a plain surface in this particular embodiment.

The gas guiding structure which includes the guide ring 6 is mounted on an extension portion which projects from a base mounting portion surrounding the barrel end 1*a*. The shell or ring assembly 9 forms the base portion of the guide ring mounting means. Support members or bolts 8 are attached at one end thereof to the shell 9 and project beyond the barrel end 1*a*. The shell 9 includes two portions in this specific embodiment and has flange sections 9*a* which are firmly connected to each other by screw bolts 10. Any type of fastening means may be used to attach the shell member 9 to the barrel end 1*a*. The bolts 8 are screwed into corresponding threaded holes 11 located in the guide ring 6. The ends of the bolts 8 which are fastened to the base portion include screw caps 12 and threaded pins 13 which provide a safety device.

ADVANTAGES OF THIS INVENTION

The use of a gas guiding structure to maintain additional guidance to emerging firing gases results in many advantages over muzzle assemblies known in the prior art. Areas of turbulence can no longer be formed at the muzzle end and therefore the trajectory and the velocity of the fin-stabilized projectile are not adversely affected. The muzzle assembly of this invention provides a smooth and laminar flow of gases from the barrel and thereby provides an unimpeded escape velocity for the fin-stabilized projectile. That is, the prevention of any build-up of escaping gases in the area either inside or outside the barrel end removes any impediment to the velocity of the projectile and could possibly cause an increase in the velocity thereby improving the range and trajectory of the projectile.

While the muzzle assembly for smooth-bore barrels has been shown and described in detail, it is obvious that this invention is not to be considered as being limited to the exact form disclosed, and that changes in detail and construction may be made therein within the scope of the invention, without departing from the spirit thereof.

We claim:

1. A firearm for firing fin-stabilized projectiles with improved accuracy comprising a. a smooth-bore barrel and b. a muzzle assembly secured to the end of said barrel, c. said muzzle assembly comprising a ring assembly secured about said barrel adjacent the end thereof, a plurality of spaced parallel, elongated support members arranged about the periphery of said barrel and extending from said ring assembly in a direction substantially parallel to the axis of said barrel beyond the end of said barrel, and a single, annular, complete ring member mounted on said support member spaced from the end of said barrel, providing a plurality of apertures, each defined by a pair of said support members, the end of said barrel and said ring member to exhaust firing gas therethrough, d. the diameter of the inner surface of said ring member being substantially equal to the internal diameter of said smooth-bore barrel and the minimum length of said apertures, considered in an axial direction, being one and one-quarter times the internal diameter of the barrel, and e. said ring member having an annular concave deflection surface adjacent said apertures extending in a direction radially with respect to the axis of the barrel and oblique in the downstream direction considering the direction of flow of gases through the barrel, no part of said deflection surface being at an acute angle in the upstream direction with respect to the axis of the barrel, f. whereby exhaust firing gases which continue to flow in a generally axial direction after passing through said apertures are deflected by said ring member in a generally oblique-radial direction to provide an unimpeded escape velocity for the fin-stabilized projectile and avoid turbulence beyond the end of the barrel, and the trajectory of the fin-stabilized projectile is maintained accurate by said ring member.

2. A firearm as defined in claim 1 wherein said ring assembly is segmented and means is provided for securing said segmented ring about said barrel adjacent the end thereof.

* * * * *